US011341786B1

(12) United States Patent
Calmer et al.

(10) Patent No.: US 11,341,786 B1
(45) Date of Patent: May 24, 2022

(54) DYNAMIC DELIVERY OF VEHICLE EVENT DATA

(71) Applicant: Samsara Inc., San Francisco, CA (US)

(72) Inventors: Mathew Chasan Calmer, Sacramento, CA (US); Jesse Chen, San Francisco, CA (US); Saumya Jain, San Francisco, CA (US); Kavya Joshi, Mammoth Lakes, CA (US); Justin Pan, San Francisco, CA (US); Ryan Milligan, Great Falls, VA (US); Justin Delegard, West Chester, OH (US); Jason Symons, Dublin, CA (US)

(73) Assignee: SAMSARA INC., San Francisco, CA (US)

( * ) Notice: Subject to any disclaimer, the term of this patent is extended or adjusted under 35 U.S.C. 154(b) by 0 days.

(21) Appl. No.: 17/346,801

(22) Filed: Jun. 14, 2021

Related U.S. Application Data

(60) Provisional application No. 63/113,645, filed on Nov. 13, 2020.

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01); *G07C 5/0816* (2013.01); *G07C 5/0866* (2013.01)

(58) Field of Classification Search
CPC .... G07C 5/008; G07C 5/0866; G07C 5/0808; G07C 5/0816
See application file for complete search history.

(56) References Cited

U.S. PATENT DOCUMENTS

| | | | | |
|---|---|---|---|---|
| 5,917,433 | A | 6/1999 | Keillor et al. | |
| 6,452,487 | B1 | 9/2002 | Krupinski | |
| 8,633,672 | B2 | 1/2014 | Jung et al. | |
| 8,774,752 | B1 * | 7/2014 | Akcasu | H04W 4/90 455/404.1 |
| 9,024,744 | B2 | 5/2015 | Klose et al. | |
| 9,445,270 | B1 | 9/2016 | Bicket et al. | |
| 9,477,639 | B2 | 10/2016 | Fischer et al. | |
| 9,731,727 | B2 | 8/2017 | Heim et al. | |
| 9,952,046 | B1 | 4/2018 | Blacutt et al. | |
| 10,033,706 | B2 | 7/2018 | Bicket et al. | |

(Continued)

FOREIGN PATENT DOCUMENTS

| | | | |
|---|---|---|---|
| CN | 108446600 | A | 8/2018 |
| KR | 102324978 | B1 | 11/2021 |

OTHER PUBLICATIONS

U.S. Appl. No. 17/475,114, Dash Cam With Artificial Intelligence Safety Event Detection, Sep. 14, 2021.

(Continued)

*Primary Examiner* — Mussa A Shaawat
(74) *Attorney, Agent, or Firm* — Knobbe, Martens, Olson & Bear LLP

(57) ABSTRACT

An improved system and method of selectively transmitting asset data from one or more sensors associated with the vehicle to a backend server, which is configured to analyze the asset data and, if necessary for further analysis of the asset data (e.g., to determine whether a safety event has occurred) and/or to provide actionable data for review by a safety analyst, requests further asset data from a vehicle device.

14 Claims, 7 Drawing Sheets

(56) References Cited

U.S. PATENT DOCUMENTS 10,085,149 B2 9/2018 Bicket et al.
10,102,495 B1 10/2018 Zhang et al.
10,173,486 B1 1/2019 Lee et al.
10,173,544 B2 1/2019 Hendrix et al.
10,196,071 B1 2/2019 Rowson et al.
10,206,107 B2 2/2019 Bicket et al.
10,255,528 B1 4/2019 Nguyen
10,390,227 B2 8/2019 Bicket et al.
10,489,222 B2 11/2019 Sathyanarayana et al.
10,503,990 B2 12/2019 Gleeson-May et al.
10,579,123 B2 3/2020 Tuan et al.
10,609,114 B1 3/2020 Bicket et al.
10,623,899 B2 4/2020 Watkins et al.
10,827,324 B1 11/2020 Hajimiri et al.
10,843,659 B1 11/2020 Innocenzi et al.
10,999,374 B2 * 5/2021 ElHattab ..... G07C 5/0841
11,046,205 B1 6/2021 Govan et al.
11,122,488 B1 9/2021 Lloyd et al.
11,126,910 B1 9/2021 Akhtar et al.
11,128,130 B2 9/2021 Jain et al.
11,131,986 B1 9/2021 Gal et al.
11,132,853 B1 9/2021 Akhtar et al.
11,137,744 B1 10/2021 Heddleston et al.
11,158,177 B1 10/2021 ElHattab et al.
11,184,422 B1 11/2021 Bicket et al.
11,188,046 B1 11/2021 ElHattab et al.
11,190,373 B1 11/2021 Stevenson et al.
2002/0061758 A1 5/2002 Zarlengo et al.
2002/0093565 A1 * 7/2002 Watkins ..... B60R 11/02 348/148
2005/0286774 A1 12/2005 Porikli
2006/0167591 A1 7/2006 McNally
2007/0080816 A1 4/2007 Haque et al.
2008/0252412 A1 10/2008 Larsson et al.
2008/0319602 A1 12/2008 McClellan et al.
2009/0034801 A1 2/2009 Hammoud
2009/0240427 A1 9/2009 Siereveld et al.
2010/0049639 A1 2/2010 Ferro et al.
2011/0276265 A1 11/2011 Husain
2012/0076437 A1 * 3/2012 King ..... G06Q 10/10 382/286
2012/0201277 A1 8/2012 Tanner et al.
2012/0235625 A1 9/2012 Takehara
2012/0303397 A1 11/2012 Prosser
2013/0073114 A1 3/2013 Nemat-Nasser et al.
2013/0162421 A1 6/2013 Inaguma et al.
2013/0244210 A1 9/2013 Nath et al.
2014/0012492 A1 1/2014 Bowers et al.
2014/0095061 A1 4/2014 Hyde
2014/0098060 A1 4/2014 McQuade et al.
2014/0193781 A1 7/2014 Sands
2014/0195106 A1 7/2014 McQuade et al.
2014/0195477 A1 7/2014 Graumann et al.
2014/0278108 A1 9/2014 Kerrigan et al.
2014/0324281 A1 10/2014 Nemat-Nasser et al.
2014/0354227 A1 12/2014 Tyagi et al.
2014/0354228 A1 12/2014 Williams et al.
2014/0376876 A1 * 12/2014 Bentley ..... G06K 9/00744 386/227
2015/0024705 A1 * 1/2015 Rashidi ..... G08B 13/19669 455/404.2
2015/0035665 A1 * 2/2015 Plante ..... B60K 35/00 340/438
2015/0044641 A1 2/2015 Chauncey et al.
2015/0074091 A1 3/2015 Walkin et al.
2015/0084757 A1 * 3/2015 Annibale ..... G08B 25/016 340/436
2015/0116114 A1 * 4/2015 Boyles ..... G08B 25/00 340/539.17
2015/0226563 A1 8/2015 Cox et al.
2015/0283912 A1 10/2015 Shimizu et al.
2016/0034770 A1 2/2016 Peterson et al.
2016/0046298 A1 2/2016 DeRuyck et al.
2016/0267335 A1 9/2016 Hampiholi
2016/0275376 A1 9/2016 Kant
2016/0288744 A1 10/2016 Rutherford et al.
2016/0343091 A1 11/2016 Han et al.
2016/0375780 A1 12/2016 Penilla et al.
2017/0039784 A1 2/2017 Gelbart et al.
2017/0053555 A1 2/2017 Angel et al.
2017/0055868 A1 3/2017 Hatakeyama
2017/0061222 A1 3/2017 Hoye et al.
2017/0088142 A1 3/2017 Hunt et al.
2017/0102463 A1 4/2017 Hwang
2017/0113664 A1 4/2017 Nix
2017/0140603 A1 5/2017 Ricci
2017/0200061 A1 7/2017 Julian et al.
2017/0217444 A1 8/2017 Chaston et al.
2017/0263049 A1 9/2017 MacDonald et al.
2017/0286838 A1 10/2017 Cipriani et al.
2017/0291611 A1 10/2017 Innes et al.
2017/0292848 A1 10/2017 Nepomuceno et al.
2017/0332199 A1 11/2017 Elliott et al.
2017/0345283 A1 11/2017 Kwon et al.
2017/0366935 A1 12/2017 Ahmadzadeh et al.
2018/0001771 A1 1/2018 Park et al.
2018/0012196 A1 1/2018 Ricci et al.
2018/0025636 A1 1/2018 Boykin et al.
2018/0039862 A1 2/2018 Hyatt et al.
2018/0063576 A1 3/2018 Tillman et al.
2018/0093672 A1 4/2018 Terwilliger et al.
2018/0126901 A1 5/2018 Levkova et al.
2018/0189913 A1 * 7/2018 Knopp ..... G06Q 40/08
2018/0232583 A1 8/2018 Wang et al.
2018/0259353 A1 9/2018 Tsurumi et al.
2018/0262724 A1 9/2018 Ross
2018/0276485 A1 9/2018 Heck et al.
2018/0288182 A1 10/2018 Tong et al.
2018/0365888 A1 12/2018 Satzoda et al.
2019/0003848 A1 1/2019 Hoten et al.
2019/0019068 A1 1/2019 Zhu et al.
2019/0023208 A1 1/2019 Boston et al.
2019/0050657 A1 2/2019 Gleeson-May et al.
2019/0118655 A1 4/2019 Grimes et al.
2019/0174158 A1 6/2019 Herrick et al.
2019/0244301 A1 8/2019 Seth et al.
2019/0286948 A1 9/2019 Sathyanarayana et al.
2019/0318419 A1 10/2019 VanderZanden
2019/0327590 A1 10/2019 Kubo et al.
2019/0327613 A1 10/2019 Bicket et al.
2019/0370577 A1 12/2019 Meng et al.
2020/0074397 A1 3/2020 Burda et al.
2020/0086879 A1 3/2020 Lakshmi Narayanan et al.
2020/0139847 A1 5/2020 Baumer et al.
2020/0150739 A1 5/2020 Tuan et al.
2020/0162489 A1 * 5/2020 Bar-Nahum ..... G06N 20/00
2020/0192355 A1 * 6/2020 Lu ..... G08G 1/0112
2020/0294220 A1 9/2020 Gonzalez Diaz et al.
2020/0312063 A1 10/2020 Balakrishnan et al.
2020/0327345 A1 10/2020 Schumacher et al.
2020/0342230 A1 10/2020 Tsai et al.
2020/0342235 A1 10/2020 Tsai et al.
2020/0342274 A1 * 10/2020 ElHattab ..... B60Q 9/00
2020/0342506 A1 10/2020 Levy et al.
2020/0342611 A1 * 10/2020 ElHattab ..... G06T 7/248
2020/0344301 A1 10/2020 ElHattab et al.
2020/0371773 A1 11/2020 Kato et al.
2020/0389415 A1 12/2020 Zhao et al.
2021/0006950 A1 1/2021 Hajimiri et al.
2021/0073626 A1 3/2021 Brahma et al.
2021/0201666 A1 7/2021 Pelleg et al.
2021/0245749 A1 8/2021 Ross et al.
2021/0287066 A1 9/2021 Xie et al.
2021/0394775 A1 12/2021 Julian et al.

OTHER PUBLICATIONS

U.S. Appl. No. 17/454,773, Refining Event Triggers Using Machine Learning Model Feedback, Nov. 12, 2021.
U.S. Appl. No. 17/454,790, Tuning Layers of a Modular Neural Network, Nov. 12, 2021.

(56) References Cited

OTHER PUBLICATIONS

U.S. Appl. No. 17/454,799, An Ensemble Neural Network State Machine for Detecting Distractions, Nov. 12, 2021.

* cited by examiner

Safety Dashboard

Inbox (62) Starred Archived Dismissed 3 events selected ☆ Star | Archive | ⊗ Dismiss

| EVENT TYPE | EVENT TIME ▽ | DRIVER | VEHICLE | LOCATION |
|---|---|---|---|---|
| ☑ Harsh Braking | Feb 13th, 2:01 pm | Anna | Truck 31345 | 73rd Avenue, Oakland, CA |
| ☐ Harsh Braking | Feb 13th, 11:53 am | Oliver | Truck 15341 | San Francisco, CA |
| ☑ Harsh Acceleration | Feb 13th, 10:11 am | Michael | Delivery 27329 | Oakland, CA |
| ☐ Harsh Turn | Feb 13th, 9:02 am | Bo | Truck 54321 | Ulloa Street, San Francisco, CA |
| ☑ Harsh Turn | Feb 12th, 5:32 pm | Shaquille | Truck 213231 | East Pacheco Boulevard (CA 33; CA 152), 5.4 mi E Los Banos, CA |
| ☐ Harsh Acceleration | Feb 12th, 3:53 pm | Anthony | Wagon 84291 | Washington Avenue, San Leandro, CA |

FIG. 4

DYNAMIC DELIVERY OF VEHICLE EVENT DATA

TECHNICAL FIELD

Embodiments of the present disclosure relate to devices, systems, and methods that efficiently communicate data between a vehicle and a backend server.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Transmitting asset data from a vehicle to a backend server is expensive, both in terms of use of available bandwidth (e.g., wireless or cellular bandwidth is limited based on carrier, geography, weather, etc.) and monetary cost for sending data (e.g., carrier cost per byte of data). Additionally, much of the asset data is not critical for immediate analysis. Furthermore, if all asset data is transmitted, bandwidth for those portions that are important for immediate analysis, and possibly feedback to the driver of the vehicle, may be slowed due to bandwidth or coverage constraints.

SUMMARY

The systems, methods, and devices described herein each have several aspects, no single one of which is solely responsible for its desirable attributes. Without limiting the scope of this disclosure, several non-limiting features will now be described briefly.

In one embodiment, an improved system and method of selectively transmitting sensor data from vehicle sensors to a backend server is described herein. The backend server may be configured to analyze the sensor data and selectively request further sensor data from the vehicle, such as to provide actionable data to a safety analyst, to allow updating and tuning of event detection models on the backend, and/or for other purposes. Thus, the amount of data transmitted to the backend server may be largely reduced, while maintaining the ability for the backend server to obtain as much data as needed. The system may incorporate a feedback mechanism that periodically updates event models used by the vehicle device to provide immediate in-vehicle alerts, such as when the backend server has optimized the event models based on analysis of data assets associated with many events.

Further, as described herein, according to various embodiments systems and or devices may be configured and/or designed to generate graphical user interface data useable for rendering the various interactive graphical user interfaces described. The graphical user interface data may be used by various devices, systems, and/or software programs (for example, a browser program), to render the interactive graphical user interfaces. The interactive graphical user interfaces may be displayed on, for example, electronic displays (including, for example, touch-enabled displays).

Additionally, the present disclosure describes various embodiments of interactive and dynamic graphical user interfaces that are the result of significant development. This non-trivial development has resulted in the graphical user interfaces described herein which may provide significant cognitive and ergonomic efficiencies and advantages over previous systems. The interactive and dynamic graphical user interfaces include improved human-computer interactions that may provide reduced mental workloads, improved decision-making, improved capabilities, reduced work stress, and/or the like, for a user. For example, user interaction with the interactive graphical user interface via the inputs described herein may provide an optimized display of, and interaction with, machine vision devices, and may enable a user to more quickly and accurately access, navigate, assess, and digest analyses, configurations, image data, and/or the like, than previous systems.

Various embodiments of the present disclosure provide improvements to various technologies and technological fields, and practical applications of various technological features and advancements. For example, as described above, existing machine vision systems are limited in various ways, and various embodiments of the present disclosure provide significant improvements over such technology, and practical applications of such improvements. Additionally, various embodiments of the present disclosure are inextricably tied to, and provide practical applications of, computer technology. In particular, various embodiments rely on detection of user inputs via graphical user interfaces, operation and configuration of machine vision devices, calculation of updates to displayed electronic data based on user inputs, automatic processing of image data, and presentation of updates to displayed images and analyses via interactive graphical user interfaces. Such features and others are intimately tied to, and enabled by, computer and machine vision technology, and would not exist except for computer and machine vision technology.

BRIEF DESCRIPTION OF THE DRAWINGS

The following drawings and the associated descriptions are provided to illustrate embodiments of the present disclosure and do not limit the scope of the claims. Aspects and many of the attendant advantages of this disclosure will become more readily appreciated as the same become better understood by reference to the following detailed description, when taken in conjunction with the accompanying drawings, wherein:

FIG. 4 illustrates an example Safety Dashboard configured to list the most recent safety events detected across a fleet of vehicles that are associated with a safety manager.

DETAILED DESCRIPTION

Figure 1A:
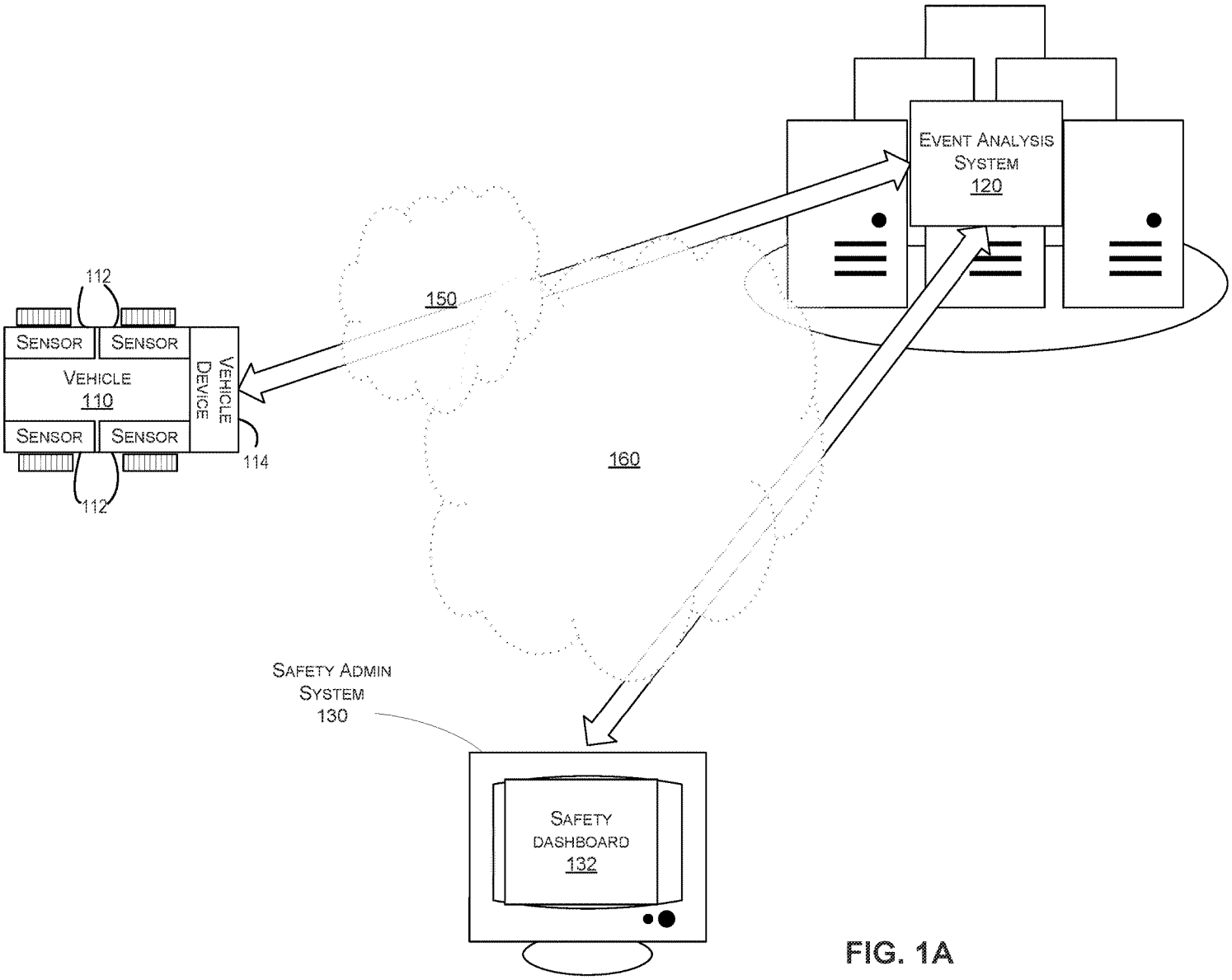
FIG. 1A illustrates an event analysis system in communication with a vehicle device and a safety admin system.

Although certain preferred embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Overview

As mentioned above, according to various embodiments, an improved system and method of selectively transmitting asset data from one or more sensors associated with the vehicle to a backend server, which is configured to analyze the asset data and, if necessary for further analysis of the asset data (e.g., to determine whether a safety event has occurred), requests further asset data from the vehicle. In some safety event detection systems, many of the data assets uploaded are associated with false positive events. Additionally, all data assets associated with true positive events do not necessarily add value to a safety dashboard.

A backend (or "cloud") server may have context and perspective that individual vehicle devices do not have. For example, the backend may include data associate with a large quantity of vehicles, such as vehicles across a fleet or within a geographic area. Thus, the backend may perform analysis of data assets across multiple vehicles, as well between groups of vehicles (e.g., comparison of fleets operated by different entities). The backend can use uploaded data assets to optimize for both customer experience and data transfer quantity. For example, using metadata from a harsh event (whether false or positive harsh event), the backend can make an informed go/no-go decision on whether a particular event should be shown in a safety dashboard or whether it may be a false positive. The backend may then decide whether data assets associated with the safety event should be transmitted from the vehicle device to the backend, for example only if the detected event is a positive event or an event meeting certain criteria. Thus, the amount of data transmitted to the backend server may be largely reduced, while maintaining the ability for the backend server to obtain as much data as needed to apply alert criteria and transmit corresponding alerts. An event analysis system may also include a feedback system that periodically updates event models used by vehicle devices to provide immediate in-vehicle alerts, such as when the backend server has optimized an event model based on analysis of data assets associated with many safety events, potentially across multiple fleets of vehicles.

Terms

To facilitate an understanding of the systems and methods discussed herein, several terms are described below. These terms, as well as other terms used herein, should be construed to include the provided descriptions, the ordinary and customary meanings of the terms, and/or any other implied meaning for the respective terms, wherein such construction is consistent with context of the term. Thus, the descriptions below do not limit the meaning of these terms, but only provide example descriptions.

Vehicle Device: an electronic device that includes one or more sensors positioned on or in a vehicle. A vehicle device may include sensors such as one or more video sensors, audio sensors, accelerometers, global positioning systems (GPS), and the like. Vehicle devices include communication circuitry configured to transmit event data to a backend (or "cloud" server). Vehicle devices also include memory for storing software code that is usable to execute one or more event detection models that allow the vehicle device to trigger events without communication with the backend. A vehicle device may also store data supplied from the backend, such as map data, speed limit data, traffic rules data, and the like. Such data may be used at the vehicle device to determine if triggering criteria for an event have been matched.

Events of interest (or "event") are, generally, circumstances of interest to a safety advisor, fleet administrator, vehicle driver, or others. Events may be identified based on various combinations of characteristics associated with one or more vehicles. For example, a safety event associated with a vehicle may occur when the vehicle is moving at a speed that is more than 20 mph above the speed limit.

Safety Event: an event that indicates an accident involving a vehicle, such as a crash of the vehicle into another vehicle or structure, or an event that indicates an increased likelihood of a crash of vehicle.

Driver Assistance Event: one type of safety event that does not necessarily indicate a crash, or imminent crash, but indicates that the driver should take some action to reduce likelihood of a crash. For example, driver assistance events may include safety events indicating that a vehicle is tailgating another vehicle, the vehicle is at risk of a forward collision, or the driver of the vehicle appears distracted.

Harsh Event: one type of safety event indicating an extreme action of a driver and/or status of a vehicle. Harsh events may include, for example, detecting that a driver has accelerated quickly, has braked extensively, has made a sharp turn, or that the vehicle has crashed.

Event Model (or "triggering criteria"): a set of criteria that may be applied to data assets to determine when an event has occurred. An event model may be a statistical model taking as input one or more types of vehicle data. An event model may be stored in any other format, such as a list of criteria, rules, thresholds, and the like, that indicate occurrence of an event. An event model may additionally, or alternatively, include one or more neural networks or other artificial intelligence.

Event Data: data associated with an event. Event data may include data assets (e.g., photographs, video files, etc.) associated with a detected safety event. Event data may include data assets that were used by an event model to trigger a safety event. Event data may also include metadata regarding a detected event.

Sensor Data: any data obtained by the vehicle device, such as asset data and metadata.

Asset Data: any data associated with a vehicle, such as data that is usable by an event model to indicate whether a safety event has occurred. Data assets may include video files, still images, audio data, and/or other data files. In some implementations, asset data includes certain metadata, as defined below. Data assets may include:

- Video files, which may be uploaded for each camera and may be controllable individually. Video files that are uploaded to the backend may be set to a default length (e.g., 3 seconds before and 3 seconds after the detected safety event) and/or may be selected based on rules associated with the detected event. Video transcode may be customized, at the vehicle device and/or by the backend, to adjust the bit rate, frame rate, resolution, etc. of video files that are transmitted to the backend.
- Still Images from each camera, e.g., single frames of a video file, may be transmitted to the backend either as part of initial event data transmitted to the backend after detecting a safety event and/or in response to a request for still images from the backend. In situations where the backend requests still images from a vehicle device, the backend may determine image settings (e.g., image quality, down sampling rate, file size, etc.), as well as timeframe from which images are requested (e.g., one image every 0.2 seconds for the five section time period preceding the detected event).
- Audio data can be combined with video, or sent separately and transcoded into video files after the fact. The backend may determine audio transcoding parameters for requested audio data.

Metadata: data that provides information regarding a detected event, typically in a more condensed manner than the related data assets. Metadata may include, for example, accelerometer data, global positioning system (GPS) data, ECU data, vehicle data (e.g., vehicle speed, acceleration data, braking data, etc.), forward camera object tracking data, driver facing camera data, hand tracking data and/or any other related data. For example, metadata regarding a triggered event may include a location of an object that triggered the event, such as a vehicle in which a FCW or Tailgating safety event has triggered, or position of a driver's head when a distracted driver event has triggered. Metadata may also include calculated data associated with a detected safety event, such as severity of the event, which may be based on rules related to duration of an event, distance to a leading vehicle, or other event data. Metadata may include information about other vehicles within the scene in the case of tailgating or FCW event, as well as confidence levels for these detections. Metadata may include confidence and headpose for a driver in the case of distracted driver event. Metadata may also include information such as event keys and other identification information, event type, event date and time stamps, event location, and the like.

Data Store: Any computer readable storage medium and/or device (or collection of data storage mediums and/or devices). Examples of data stores include, but are not limited to, optical disks (e.g., CD-ROM, DVD-ROM, etc.), magnetic disks (e.g., hard disks, floppy disks, etc.), memory circuits (e.g., solid state drives, random-access memory (RAM), etc.), and/or the like. Another example of a data store is a hosted storage environment that includes a collection of physical data storage devices that may be remotely accessible and may be rapidly provisioned as needed (commonly referred to as "cloud" storage).

Database: Any data structure (and/or combinations of multiple data structures) for storing and/or organizing data, including, but not limited to, relational databases (e.g., Oracle databases, PostgreSQL databases, etc.), non-relational databases (e.g., NoSQL databases, etc.), in-memory databases, spreadsheets, comma separated values (CSV) files, eXtendible markup language (XML) files, TeXT (TXT) files, flat files, spreadsheet files, and/or any other widely used or proprietary format for data storage. Databases are typically stored in one or more data stores. Accordingly, each database referred to herein (e.g., in the description herein and/or the figures of the present application) is to be understood as being stored in one or more data stores. Additionally, although the present disclosure may show or describe data as being stored in combined or separate databases, in various embodiments such data may be combined and/or separated in any appropriate way into one or more databases, one or more tables of one or more databases, etc. As used herein, a data source may refer to a table in a relational database, for example.

Example Event Analysis System

FIG. 1A illustrates an event analysis system 120 in communication with a vehicle device 114 and a safety admin system 130. In this embodiment, the vehicle 110 includes a vehicle device 114, which may physically incorporate and/or be coupled to (e.g., via wired or wireless communication channel) a plurality of sensors 112. The sensors 112 may include, for example, a forward facing camera and a driver facing camera. The vehicle device 114 further includes one or more microprocessors in the communication circuit configured to transmit data to the event analysis system 120, such as via one or more of the networks 150, 160. In this example, a safety dashboard 132 may be generated on a safety admin system 130 to illustrate event data from the event analysis system 120, such as via an online portal, e.g., a website or standalone application. The safety admin system 130 may be operated, for example, by a safety officer that reviews information regarding triggered safety events associated with a fleet of drivers/vehicles.

Various example computing devices 114, 120, and 130 are shown in FIG. 1A. In general, the computing devices can be any computing device such as a desktop, laptop or tablet computer, personal computer, tablet computer, wearable computer, server, personal digital assistant (PDA), hybrid PDA/mobile phone, mobile phone, smartphone, set top box, voice command device, digital media player, and the like. A computing device may execute an application (e.g., a browser, a stand-alone application, etc.) that allows a user to access interactive user interfaces, view images, analyses, or aggregated data, and/or the like as described herein. In various embodiments, users may interact with various components of the example operating environment (e.g., the safety dashboard 130, the event analysis system 120, etc.) via various computing devices. Such interactions may typically be accomplished via interactive graphical user interfaces, however alternatively such interactions may be accomplished via command line, and/or other means.

As shown in the example of FIG. 1A, communications between the vehicle device 114 and event analysis system 120 primarily occurs via network 150, while communication between the event analysis system 120 and safety admin system 130 typically occurs via network 160. However, networks 150, 160 may include some or all of the same communication protocols, services, hardware, etc. Thus, although the discussion herein may describe communication between the vehicle device 114 and the event analysis system 120 via the network 150 (e.g., via cellular data) and communication between the event analysis system 120 and the safety admin system 130 via a wired and/or a wireless high-speed data communication network, communications of the devices are not limited in this manner.

Figure 1B:
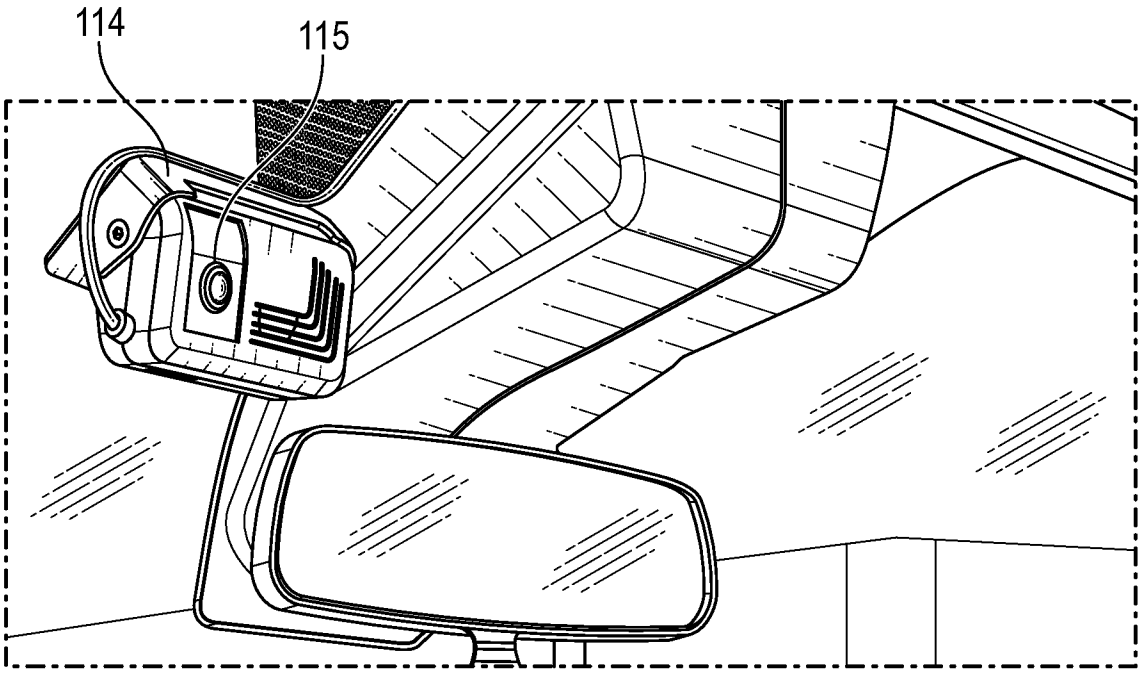
FIG. 1B illustrates an example vehicle device mounted inside a vehicle.

FIG. 1B illustrates an example vehicle device 114 mounted inside a vehicle. In this example, the vehicle device 114 includes a driver facing camera 115 and one or more outward facing cameras (not shown). In other embodiments, the vehicle device may include different quantities of video and/or still image cameras. These dual-facing cameras (e.g., the driver facing camera 115 and one or more outward-facing cameras) may be configured to automatically upload and/or analyze footage of safety events. Furthermore, the event data that is uploaded to the event analysis system 120 may be analyzed to discover driving trends and recommendations for improving driver safety. In some embodiments, one or more of the cameras may be high-definition cameras, such as with HDR and infrared LED for night recording. For example, in one embodiment the outward-facing camera includes HDR to optimize for bright and low light conditions, while the driver-facing camera includes infrared LED optimized for unlit nighttime in-vehicle video.

Vehicle device 114 may include, or may be in communication with, one or more accelerometers, such as accelerometers that measure acceleration (and/or related G forces) in each of multiple axes, such as in an X, Y, and Z axis. The vehicle device 114 may include one or more audio output devices, such as to provide hands-free alerts and/or voice-based coaching. The vehicle device may further include one or more microphones for capturing audio data. The vehicle device includes one or more computer processors, such as high-capacity processors that enable concurrent neural networks for real-time artificial intelligence.

In some embodiments, the vehicle device transmits encrypted data via SSL (e.g., 256-bit, military-grade encryption) to the event analysis system 120 via high-speed 4G LTE or other wireless communication technology, such as 5G communications. The network 150 may include one or more wireless networks, such as a Global System for Mobile Communications (GSM) network, a Code Division Multiple Access (CDMA) network, a Long Term Evolution (LTE) network, or any other type of wireless network. The network 150 can use protocols and components for communicating via the Internet or any of the other aforementioned types of networks. For example, the protocols used by the network 150 may include Hypertext Transfer Protocol (HTTP), HTTP Secure (HTTPS), Message Queue Telemetry Transport (MQTT), Constrained Application Protocol (CoAP), and the like. Protocols and components for communicating via the Internet or any of the other aforementioned types of communication networks are well known to those skilled in the art and, thus, are not described in more detail herein.

The network 160 may similarly include any wired network, wireless network, or combination thereof. For example, the network 160 may comprise one or more local area networks, wide area network, wireless local area network, wireless wide area network, the Internet, or any combination thereof.

Example Event Data Communications

Figure 2:
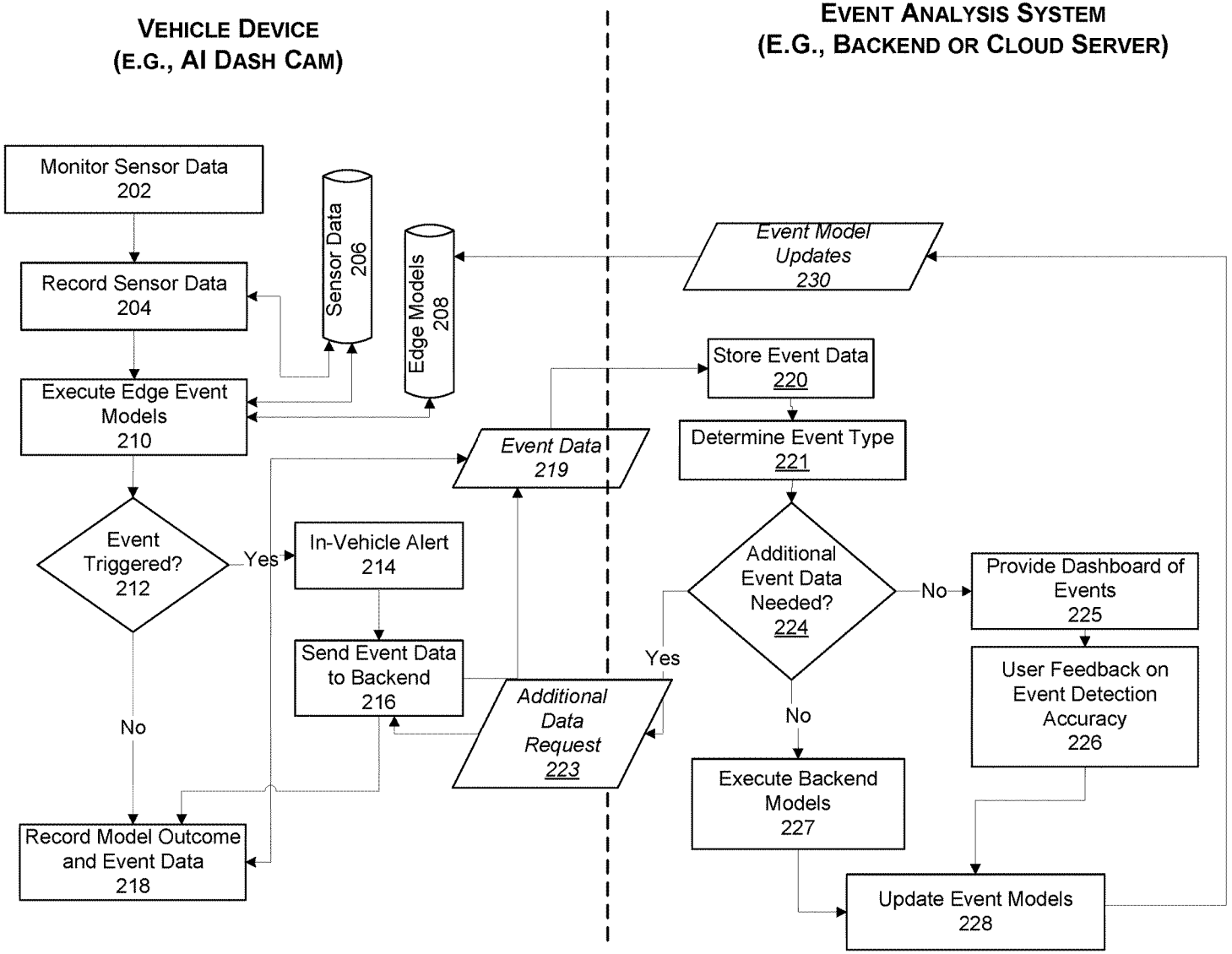
FIG. 2 is a flow diagram illustrating an example process for communicating event data between a vehicle device and an event analysis system.

FIG. 2 is a flow diagram illustrating an example process for communicating event data between a vehicle device and an event analysis system. In general, the processes illustrated on the left are performed by the vehicle device, while processes on the right are performed by an event analysis system. Depending on the embodiment, the method may include fewer or additional blocks and the blocks may be performed in an order different than is illustrated.

Beginning at block 202, sensor data (e.g., accelerometer data) is monitored by the vehicle device. For example, sensor data output from the multiple sensors 112 associated with the vehicle device 114 of FIG. 1A may be monitored and recorded at block 204. As shown, at least some of the asset data is stored in a sensor data store 206. For example, accelerometer data for a particular time period (e.g., 2, 12, 24 hours, etc.) may be stored in the sensor data store 206. Similarly, asset data, such as video data for a particular time period may be stored in the sensor data store 206.

Next, at block 210, one or more event models are executed on the sensor data. In this example, the sensor data is accessible via the sensor data store 206. The event models executed at block 210 are configured to identify harsh events indicative of a sudden, extreme, and/or unexpected movement of the vehicle and/or driver. In some embodiments, the event models are configured to trigger a harsh event based on the level of G forces sensed within the vehicle. For example, in some embodiments the vehicle device includes accelerometers that sense acceleration in each of three dimensions, e.g., along an X, Y, and Z axis. In some embodiments, the acceleration data (e.g., in $m/s^2$) is converted to g-force units (Gs) and the thresholds for triggering harsh events are in Gs. In some embodiments, a harsh event may be associated with a first acceleration threshold in the X axis, a second acceleration threshold in the Y axis, and/or a third acceleration threshold in the Z axis. In some implementations, a crash harsh event may be triggered with acceleration thresholds reached in at least two, or even one, axis. Similar acceleration thresholds in one or more of the X, Y, and Z axes are associated with other harsh events, such as harsh acceleration, harsh breaking, and harsh turning. In some embodiments, gyroscope data (e.g., orientation, angular velocity, etc.) may be used by event models, such as to detect an event based on a combination of gyroscope and acceleration data, or any other combination of data.

Figure 3:
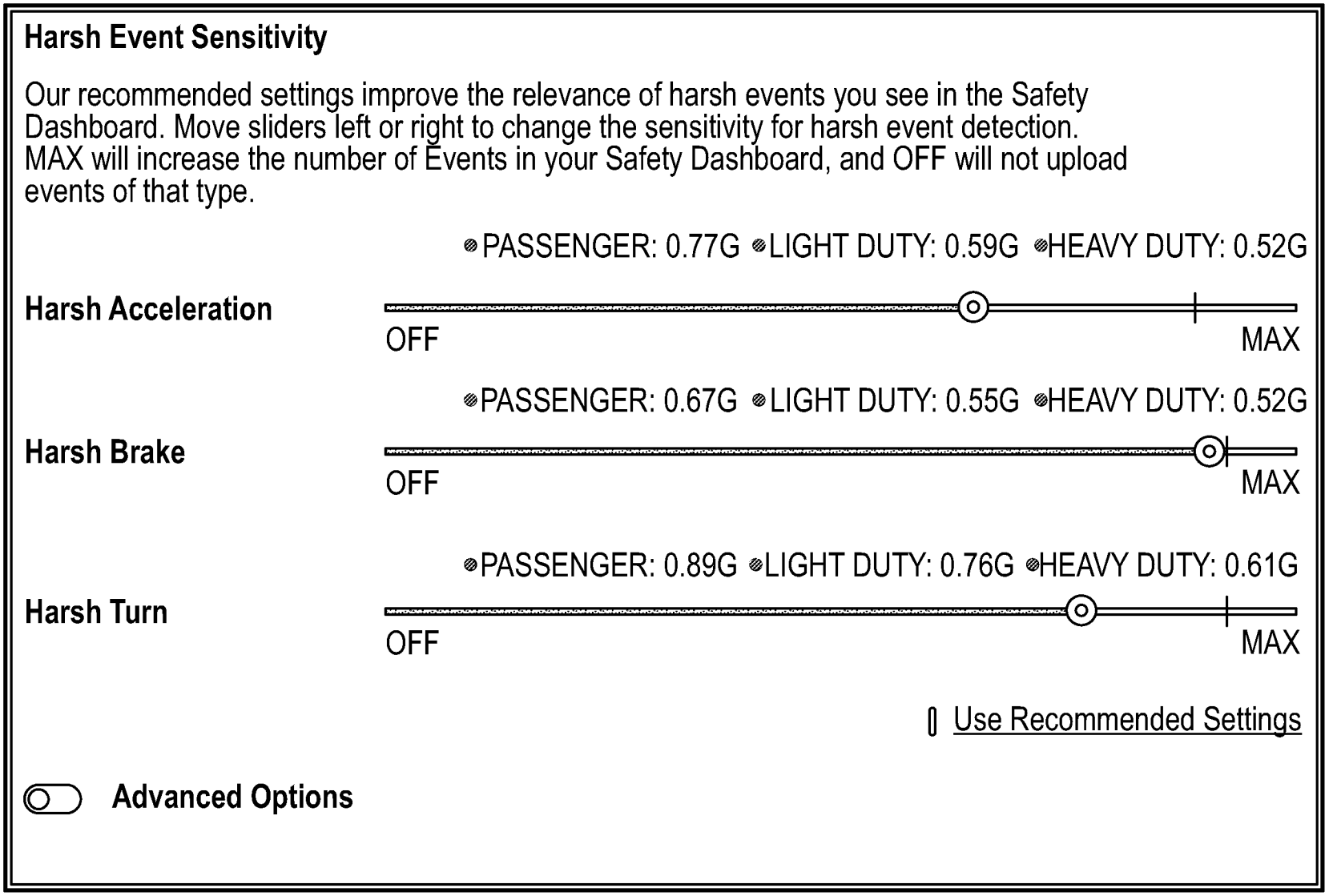
FIG. 3 is an example user interface that may be accessed by a user to designate harsh event customizations for a particular vehicle or group of vehicles (e.g., a fleet of similar delivery trucks).

In some embodiments, the thresholds are determined by a user configurable setting, allowing the user (e.g., an owner or manager of a fleet) to either use defaults based on vehicle type (e.g., passenger, light duty or heavy duty), or to set custom combinations of acceleration thresholds that must be met to trigger an associated harsh event. For example, a user may set triggering thresholds for harsh events via the safety dashboard 132. FIG. 3 is an example user interface that may be accessed by a user to designate harsh event customizations for a particular vehicle or group of vehicles (e.g., a fleet of similar delivery trucks). In this example, the user may select a threshold acceleration (in this example shown in G forces) for each of three different harsh events, namely acceleration, breaking, and turning. The user interface provides default levels based on type of vehicle, which the user can choose to implement and/or can move the sliders associated with the three different types of harsh events to select a custom G force level. In this example, G force levels in the X axis (e.g., corresponding to a length of a vehicle) may be used to trigger the harsh acceleration and harsh breaking events, while G force levels in the Y axis (e.g., perpendicular to the X axis) may be used to trigger the harsh turn event. In some embodiments, a particular harsh event may not be triggered until multiple G force levels reach a threshold, such as a X and z axis threshold that may be associated with a harsh turn event.

In some embodiments, harsh event models (e.g., rules, algorithms, criteria, psuedocode, etc.) may only trigger safety events when the vehicle device is currently "on a trip", which may be defined by one or more thresholds that are set to default levels and, in some implementations, may be customized by the user. For example, if the vehicle has a speed that is greater than zero, the vehicle may be deemed on a trip. As another example, GPS movement may be used to determine whether the vehicle is on a trip, alone or in combination with other data, such as vehicle speed and/or any other available data. In some embodiments, harsh events are only triggered when the vehicle is moving faster than a floor threshold, such as greater than 5 mph, to reduce noise and false positives in triggered safety events. In some embodiments, the vehicle device is calibrated when initially positioned in the vehicle, or moved within the vehicle, to determine the orientation of the vehicle device within the vehicle, e.g., to define the X, Y, and Z axes of the vehicle with reference to the vehicle device. This orientation may be important for proper scaling and calculation of G forces. In some embodiments, harsh events may not be triggered until proper calibration of the vehicle device is completed.

Moving to block 212, if a harsh event has been triggered, the method continues to block 214 where an in-vehicle alert 214 may be provided within the vehicle and event data associated with the harsh event is identified and transmitted to the event analysis system (block 216). The in-vehicle alerts may be customized, such as based on the type of triggered event, severity of the event, driver preferences, etc. For example, in-vehicle alerts may include various audible signals and/or visual indicators of triggered safety events. In some implementations, the event data 219 that is transmitted to the event analysis system includes metadata associated with the triggered event. For example, the metadata may include a triggering reason (e.g., an indication of which harsh event was triggered) and acceleration data in at least the axis associated with the triggered acceleration threshold. Additional metadata, such as location of the vehicle (e.g., from a GPS sensor), speed of the vehicle, and the like, may also be included in event data 219. In some embodiments, event data that is transmitted to the event analysis system is selected based on settings of the triggered safety event. For example, a first harsh event may indicate that the event data 219 that is initially transmitted to the event analysis system comprises particular metadata, e.g., accelerometer data, for a first time frame (e.g., from five seconds before the event triggered until two seconds after the event triggered). Similarly, a second harsh event may indicate that the event data 219 that is initially transmitted to the event analysis system comprises a different subset of metadata for a different time frame. Additionally, the event data to 19 that is initially transmitted to the event analysis system may include data assets, such as one or more frames of video data from one or more of the forward-facing and/or driver-facing cameras.

In some embodiments, the vehicle device executes rules (or event models in other formats) that determine whether even the metadata is transmitted to the event analysis system. For example, a rule may indicate that triggering of a particular event type that has not been detected during a predetermined time period should not initiate transmission of event data 219 to the event analysis system. Rather, the rule may indicate that the in-vehicle alert 214 is provided to the driver as a "nudge" to correct and/or not repeat actions that triggered the safety event. The rules may further indicate that upon occurrence of the same safety event within a subsequent time period (e.g., 30 minutes, 60 minutes, etc.) causes event data 219 regarding both of the detected events to be transmitted to the event analysis system. Similarly, rules may be established to transmitted event data 219 only upon occurrence of other quantities of safety events (e.g., three, four, five, etc.) during other time periods (e.g., 10 minutes, 20 minutes, 60 minutes, two hours, four hours, etc.). Such rules may further be based upon severity of the triggered safety events, such that a high severity harsh event may be transmitted immediately to the event analysis system, while a low severity harsh event may only be transmitted once multiple additional low severity harsh events are detected.

In some embodiments, asset data, such as video and audio data, are recorded in the sensor data store 206, even though such asset data may not be transmitted to the event analysis system initially upon triggering of a harsh event (e.g., at block 216). However, in some implementations, asset data may be selected for upload to the event analysis system in response to detection of an event. For example, video data from a time period immediately preceding the detected event may be marked for transmission to the event analysis system. The asset data may be transmitted when the communication link supports transmission of the asset data, such as when the vehicle is within a geographic area with a high cellular data speed. Alternatively, the asset data may be transmitted when connected on a nightly basis, such as when the vehicle is parked in the garage and connected to Wi-Fi (e.g., that does not charge per kilobyte). Accordingly, the vehicle device advantageously provides immediate in-vehicle alerts upon detection of a harsh event, while also allowing the event analysis system to later receive asset data associated with the detected harsh event, such as to perform further analysis of the harsh event (e.g., to update harsh event models applied by the vehicle device) and/or to include certain data assets in a safety dashboard. In some implementations, the event data may be used for cross fleet analysis. For example, even if a particular fleet isn't concerned with events (or particular types of events), the event data may be usable as a reference for other fleets.

In some embodiments, once a particular asset data is transmitted to the event analysis system, that particular asset data is removed from the sensor data store 206 of the vehicle device. For example, if a five second video clip associated with a harsh event is transmitted to the event analysis system, that five second portion of the video stream may be removed from the sensor data store 206. In some embodiments, asset data is only deleted from the vehicle device when event analysis system indicates that the particular asset data may be deleted, or until the asset data has become stale (e.g., a particular asset data is the oldest timestamped data in the sensor data store 206 and additional storage space on the sensor data store 206 is needed for recording new sensor data).

In the embodiment of FIG. 2, the event analysis system receives the event data 219, which may initially be only metadata associated with a harsh event, as noted above, and stores the event data for further analysis at block 220. The event data may then be used to perform one or more processes that provide further information to a user (e.g., a safety manager associated with a vehicle in which the safety event occurred) and/or are used to improve or update the event models executed on the vehicle device. For example, FIG. 4 illustrates an example Safety Dashboard configured to list the most recent safety events detected across a fleet of vehicles that are associated with a safety manager. In this example, harsh breaking, harsh turning, and harsh acceleration events occurring in vehicles driven by multiple drivers are identified. In some embodiments, a listed safety event may be selected to cause the safety dashboard to provide further details regarding the selected safety event. For example, event data, which may include asset data that is requested via the process discussed below, may be presented to the safety manager, such as to determine actions to be taken with the particular driver.

Moving to block 221, the event analysis system may first determine an event type associated with the detected safety event. The event type may then be used to select one or more event models to be tested or updated based on the event data. For example, event data associated with a tailgating event type may be analyzed using a tailgating model in the backend that is more sophisticated than the tailgating model used in the vehicle device. For example, the event models applied in the event analysis system (or backend event models) may take as inputs additional sensor data, such as video data, in detecting occurrence of safety events. Thus, the event models applied in the event analysis system may require additional event data beyond the initial event data received initially upon triggering of the safety event at the vehicle device. Thus, in the embodiment of FIG. 2, the event analysis system at block 224 determines if additional event data is needed to execute the selected backend event model. Additionally, the event analysis system may determine that additional asset data is needed for a safety dashboard, such as to provide further information regarding a detected event that is understandable by a safety officer. For example, audio data that was not part of the initial event data transmitted to the event analysis system may be indicated as required for a particular detected event type. Thus, the event analysis system may determine that a particular time segment of audio data should be requested from the vehicle device.

If additional event data is needed, a request for the particular event data is generated and transmitted in an additional data request 223 for fulfillment by the vehicle device. In some embodiments, the additional data request 223 includes specific asset data requirements, such as a time period of requested video or audio data, minimum and/or maximum resolution, frame rate, file size, etc. The additional asset data request may be fulfilled by the vehicle device at block 216 by sending further event data 219 to the event analysis system. This process may be repeated multiple times until the event data needed to evaluate the selected backend models and/or meet the minimum requirements for a safety dashboard is provided. Similarly, in some implementations an iterative loop may be performed (any number of times) where an event model determines that more data for a more complicated (or different) model is necessary, the additional data is requested and received, and the more complicated (or different) model is then evaluated.

In some embodiments, the event analysis system applies default and/or user configurable rules to determine which asset data is requested from the vehicle device. For example, a rule may be established that excludes requests for additional asset data when asset data for the same type of safety event has already been received during a particular time period. For example, the rules may indicate that asset data is requested only for the first 5 occurrence of harsh turning events during a working shift of a driver. Thus, the event analysis system receives additional asset data for some of the harsh turning events and preserves bandwidth and reduces costs by not requesting asset data for all of the harsh turning events, due to the limited value of analyzing the additional asset data associated with a recurring triggered safety event.

In some embodiments, an additional data request 223 includes an indication of urgency of fulfillment of the data request, such as whether the additional data (e.g., asset data or metadata) is needed as soon as possible or if acceptable to provide the asset data only when bandwidth for transmitting the asset data is freely available.

When sufficient event data is provided to the event analysis system, the selected backend models may be executed at block 227, and the asset data may be used in a safety dashboard at block 225. In some embodiments, execution of event models at the event analysis system comprises training one or more event models for better detection of the determined event type. For example, in some embodiments the event analysis system evaluates asset data that was not considered by the vehicle device in triggering the initial safety event. The event analysis system may provide suggestions and/or may automatically update event models that are restricted to analysis of certain event data (e.g., event metadata and/or certain types of asset data) based on analysis of asset data that is not analyzed by the updated event model. For example, analysis of video data associated with a safety event may identify correlations between features in the video data and acceleration data that may be used to update criteria or thresholds for triggering the particular safety event by the vehicle device (without the vehicle device analyzing video data). Advantageously, the backend may consider event data across large quantities of vehicles in determining updates to the event models that are executed on the vehicle device.

In some embodiments, event models include neural networks that are updated over time to better identify safety events. Thus, at block 227 in the example of FIG. 2, event data may become part of a training data set for updating/improving a neural network configured to detect the safety event. A number of different types of algorithms may be used by the machine learning component to generate the models. For example, certain embodiments herein may use a logistical regression model, decision trees, random forests, convolutional neural networks, deep networks, or others. However, other models are possible, such as a linear regression model, a discrete choice model, or a generalized linear model. The machine learning algorithms can be configured to adaptively develop and update the models over time based on new input received by the machine learning component. For example, the models can be regenerated on a periodic basis as new received data is available to help keep the predictions in the model more accurate as the data is collected over time. Also, for example, the models can be regenerated based on configurations received from a user or management device (e.g., 230).

Some non-limiting examples of machine learning algorithms that can be used to generate and update the models can include supervised and non-supervised machine learning algorithms, including regression algorithms (such as, for example, Ordinary Least Squares Regression), instance-based algorithms (such as, for example, Learning Vector Quantization), decision tree algorithms (such as, for example, classification and regression trees), Bayesian algorithms (such as, for example, Naive Bayes), clustering algorithms (such as, for example, k-means clustering), association rule learning algorithms (such as, for example, Apriori algorithms), artificial neural network algorithms (such as, for example, Perceptron), deep learning algorithms (such as, for example, Deep Boltzmann Machine), dimensionality reduction algorithms (such as, for example, Principal Component Analysis), ensemble algorithms (such as, for example, Stacked Generalization), and/or other machine learning algorithms. These machine learning algorithms may include any type of machine learning algorithm including hierarchical clustering algorithms and cluster analysis algorithms, such as a k-means algorithm. In some cases, the performing of the machine learning algorithms may include the use of an artificial neural network. By using machine-learning techniques, large amounts (such as terabytes or petabytes) of received data may be analyzed to generate models without manual analysis or review by one or more people.

After execution of the backend models at block 227, event models associated with the determined event type may be updated at block 228, and in some embodiments certain of the updated event models 230 are transmitted back to the vehicle device for execution in determining future safety events. The safety dashboard that is provided at block 225 may include an option for the user to provide feedback on accuracy of the detected events, such as an indication of whether the safety event actually occurred or if the triggering event should be considered a false positive. Based on this user feedback, the event models may be updated at block 228, potentially for transmission back to the vehicle device as part of event model updates 230.

Figure 5:
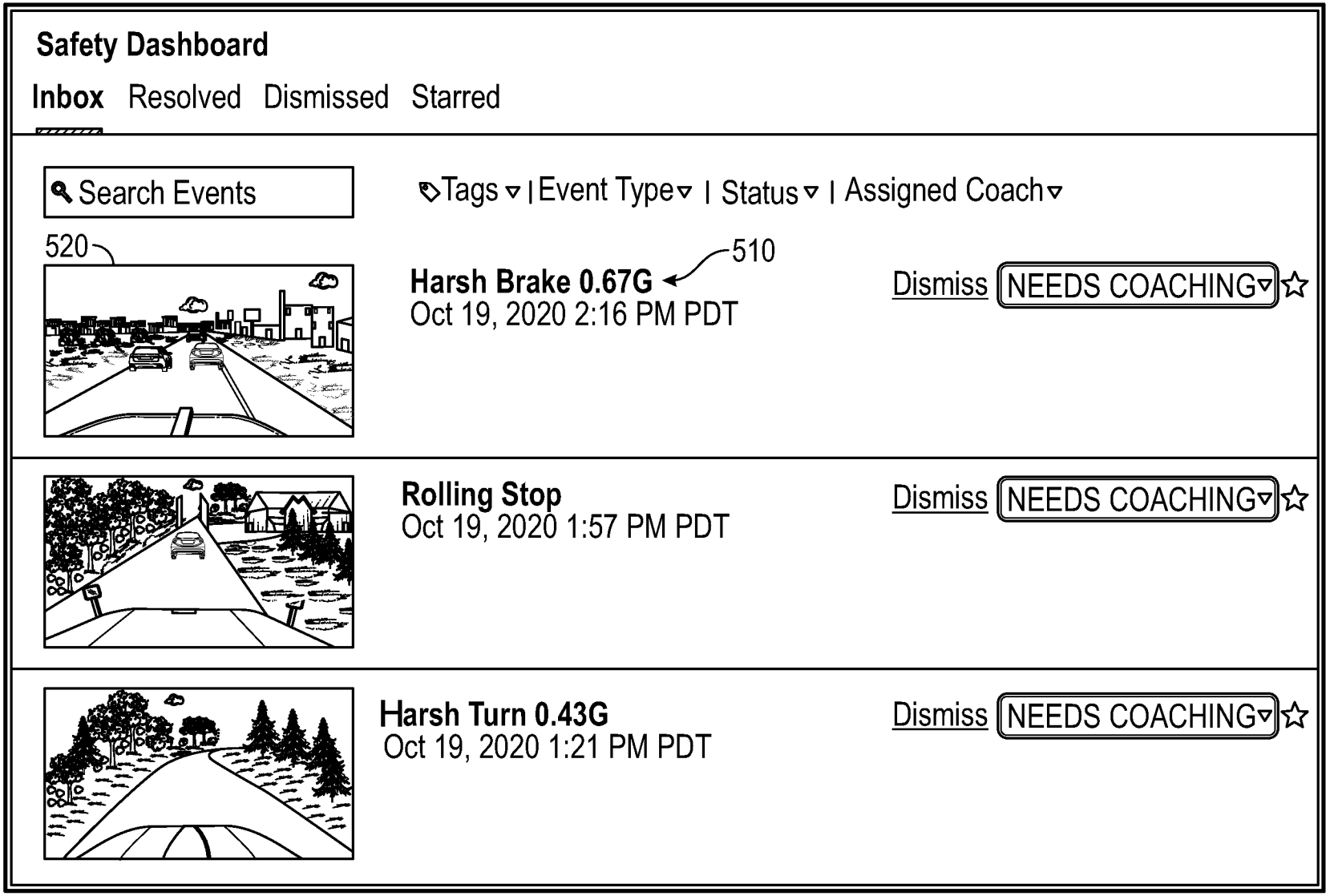
FIG. 5 is another example user interface that provides information regarding recently detected safety events for which coaching is indicated.

Example User Interfaces as noted above, FIG. 4 is an example user interface of a safety dashboard that provides an overview of the most recent harsh events detected. FIG. 5 is another example user interface that provides information regarding recently detected safety events for which coaching is indicated. In some embodiments, the dashboard of FIG. 5 is presented to a safety officer responsible for optimizing safety for a fleet of vehicles. As shown in FIG. 5, information regarding a first harsh event 510, harsh braking in this case, is provided. The information may include any of the event data that is been provided to the event analysis system. For example, information 510 includes metadata that was received initially from the vehicle device upon triggering of the harsh braking event. Advantageously, the event analysis system requested further event data from the vehicle device, including a video clip and/or snapshot 520 from the forward-facing camera of the vehicle device. Thus, the safety officer is able to view video data obtained at the same time as the harsh braking event was detected in order to develop a strategy for coaching the driver. In other embodiments, any other sensor data may be included in a safety dashboard.

Figure 6:
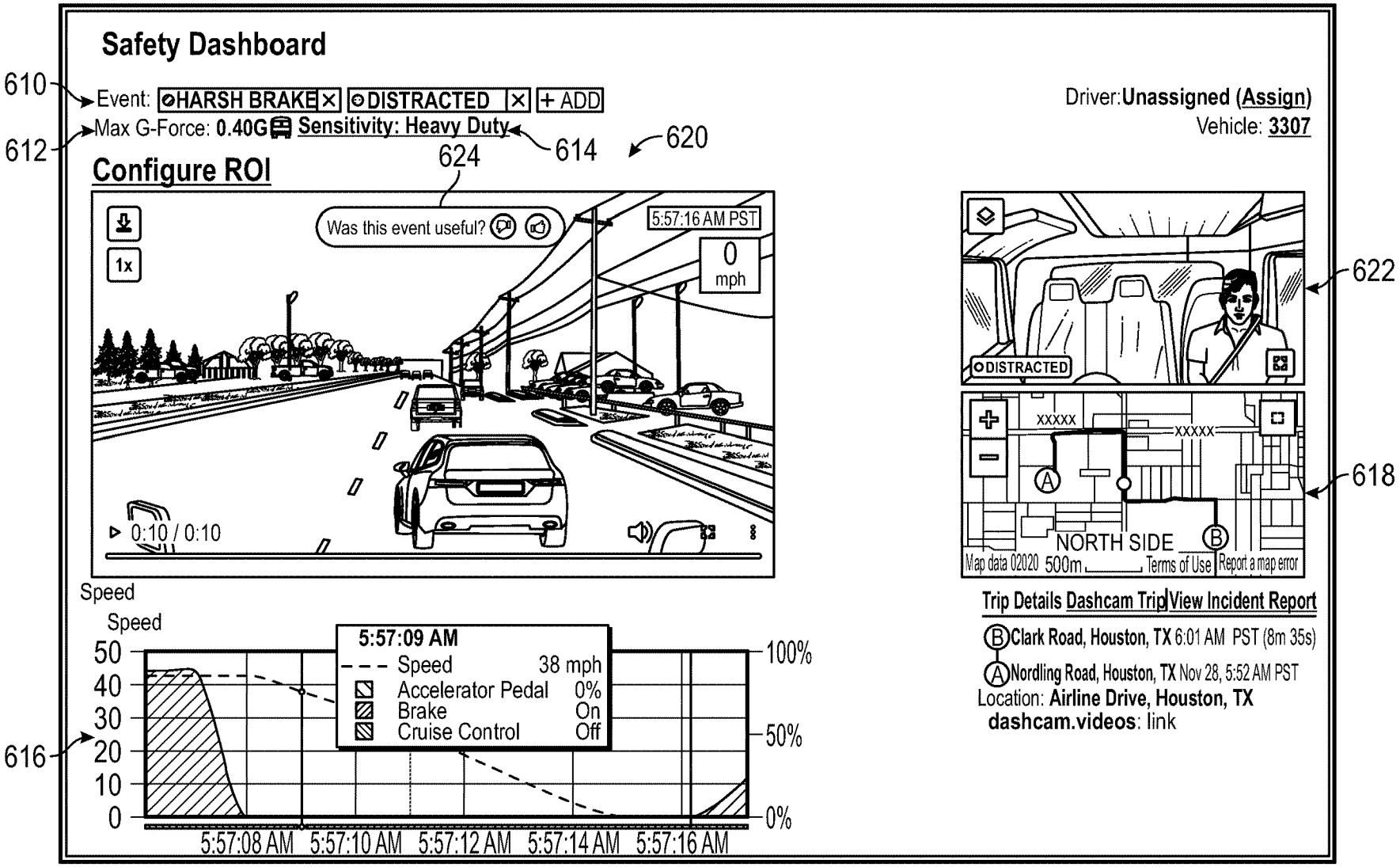
FIG. 6 is an example user interface that provides information regarding a detected safety event, including both event metadata and asset data, and provides an option for the user to provide feedback on whether the provided alert data was helpful.

FIG. 6 is an example user interface that provides information regarding a detected safety event, including both event metadata and asset data, and provides an option for the user to provide feedback on whether the provided alert data was helpful. In this example, the event type 610 is indicated as both a harsh braking and a distracted driver safety event. Additionally, the dashboard provides the maximum G force 612 detected during the event, as well as the default event model settings 614 used in detecting the event. In this example, a time series graph 616 of certain metadata associated with the detected event is illustrated. The charted metadata in graph 616 includes speed, accelerator pedal usage, brake activation indicator, and cruise control activation indicator. In other embodiments, other metadata may be charted, such as based on user preferences. In the example of FIG. 6, metadata indicating location of the vehicle (e.g., GPS data) before and after the detected event is provided in a map view 618 and video data associated with the detected event is provided in forward-facing video 620 and driver-facing video 622. Thus, the user interface brings together not only the initial metadata that was transmitted by the vehicle device after detection of the safety event, but subsequent data assets that were requested by the event analysis system. In some embodiments, the displayed data is synchronized, such that each of the forward-facing video 620, driver-facing video 622, map view 618, and time series graph 616 each depict information associated with a same point in time (e.g., a particular time during the ten seconds of event data associated with a detected safety event). As noted above, the user may interact with pop-up 624 to provide feedback to the event analysis system that may be used in updating and/or optimizing one or more event models.

Additional Implementation Details and Embodiments

Various embodiments of the present disclosure may be a system, a method, and/or a computer program product at any possible technical detail level of integration. The computer program product may include a computer readable storage medium (or mediums) having computer readable program instructions thereon for causing a processor to carry out aspects of the present disclosure.

For example, the functionality described herein may be performed as software instructions are executed by, and/or in response to software instructions being executed by, one or more hardware processors and/or any other suitable computing devices. The software instructions and/or other executable code may be read from a computer readable storage medium (or mediums).

The computer readable storage medium can be a tangible device that can retain and store data and/or instructions for use by an instruction execution device. The computer readable storage medium may be, for example, but is not limited to, an electronic storage device (including any volatile and/or non-volatile electronic storage devices), a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a solid state drive, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions (as also referred to herein as, for example, "code," "instructions," "module," "application," "software application," and/or the like) for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Java, C++, or the like, and procedural programming languages, such as the "C" programming language or similar programming languages. Computer readable program instructions may be callable from other instructions or from itself, and/or may be invoked in response to detected events or interrupts. Computer readable program instructions configured for execution on computing devices may be provided on a computer readable storage medium, and/or as a digital download (and may be originally stored in a compressed or installable format that requires installation, decompression or decryption prior to execution) that may then be stored on a computer readable storage medium. Such computer readable program instructions may be stored, partially or fully, on a memory device (e.g., a computer readable storage medium) of the executing computing device, for execution by the computing device. The computer readable program instructions may execute entirely on a user's computer (e.g., the executing computing device), partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments of the disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart(s) and/or block diagram(s) block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks. For example, the instructions may initially be carried on a magnetic disk or solid state drive of a remote computer. The remote computer may load the instructions and/or modules into its dynamic memory and send the instructions over a telephone, cable, or optical line using a modem. A modem local to a server computing system may receive the data on the telephone/cable/optical line and use a converter device including the appropriate circuitry to place the data on a bus. The bus may carry the data to a memory, from which a processor may retrieve and execute the instructions. The instructions received by the memory may optionally be stored on a storage device (e.g., a solid state drive) either before or after execution by the computer processor.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. In addition, certain blocks may be omitted in some implementations. The methods and processes described herein are also not limited to any particular sequence, and the blocks or states relating thereto can be performed in other sequences that are appropriate.

It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions. For example, any of the processes, methods, algorithms, elements, blocks, applications, or other functionality (or portions of functionality) described in the preceding sections may be embodied in, and/or fully or partially automated via, electronic hardware such application-specific processors (e.g., application-specific integrated circuits (ASICs)), programmable processors (e.g., field programmable gate arrays (FPGAs)), application-specific circuitry, and/or the like (any of which may also combine custom hard-wired logic, logic circuits, ASICs, FPGAs, etc. with custom programming/execution of software instructions to accomplish the techniques).

Any of the above-mentioned processors, and/or devices incorporating any of the above-mentioned processors, may be referred to herein as, for example, "computers," "computer devices," "computing devices," "hardware computing devices," "hardware processors," "processing units," and/or the like. Computing devices of the above-embodiments may generally (but not necessarily) be controlled and/or coordinated by operating system software, such as Mac OS, iOS, Android, Chrome OS, Windows OS (e.g., Windows XP, Windows Vista, Windows 7, Windows 8, Windows 10, Windows Server, etc.), Windows CE, Unix, Linux, SunOS, Solaris, Blackberry OS, VxWorks, or other suitable operating systems. In other embodiments, the computing devices may be controlled by a proprietary operating system. Conventional operating systems control and schedule computer processes for execution, perform memory management, provide file system, networking, I/O services, and provide a user interface functionality, such as a graphical user interface ("GUI"), among other things.

As described above, in various embodiments certain functionality may be accessible by a user through a web-based viewer (such as a web browser), or other suitable software program. In such implementations, the user interface may be generated by a server computing system and transmitted to a web browser of the user (e.g., running on the user's computing system). Alternatively, data (e.g., user interface data) necessary for generating the user interface may be provided by the server computing system to the browser, where the user interface may be generated (e.g., the user interface data may be executed by a browser accessing a web service and may be configured to render the user interfaces based on the user interface data). The user may then interact with the user interface through the web-browser. User interfaces of certain implementations may be accessible through one or more dedicated software applications. In certain embodiments, one or more of the computing devices and/or systems of the disclosure may include mobile computing devices, and user interfaces may be accessible through such mobile computing devices (for example, smartphones and/or tablets).

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

Conditional language, such as, among others, "can," "could," "might," or "may," unless specifically stated otherwise, or otherwise understood within the context as used, is generally intended to convey that certain embodiments include, while other embodiments may not include, certain features, elements, and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The term "substantially" when used in conjunction with the term "real-time" forms a phrase that will be readily understood by a person of ordinary skill in the art. For example, it is readily understood that such language will include speeds in which no or little delay or waiting is discernible, or where such delay is sufficiently short so as not to be disruptive, irritating, or otherwise vexing to a user.

Conjunctive language such as the phrase "at least one of X, Y, and Z," or "at least one of X, Y, or Z," unless specifically stated otherwise, is to be understood with the context as used in general to convey that an item, term, etc. may be either X, Y, or Z, or a combination thereof. For example, the term "or" is used in its inclusive sense (and not in its exclusive sense) so that when used, for example, to connect a list of elements, the term "or" means one, some, or all of the elements in the list. Thus, such conjunctive language is not generally intended to imply that certain embodiments require at least one of X, at least one of Y, and at least one of Z to each be present.

The term "a" as used herein should be given an inclusive rather than exclusive interpretation. For example, unless specifically noted, the term "a" should not be understood to mean "exactly one" or "one and only one"; instead, the term "a" means "one or more" or "at least one," whether used in the claims or elsewhere in the specification and regardless of uses of quantifiers such as "at least one," "one or more," or "a plurality" elsewhere in the claims or specification.

The term "comprising" as used herein should be given an inclusive rather than exclusive interpretation. For example, a general purpose computer comprising one or more processors should not be interpreted as excluding other computer components, and may possibly include such components as memory, input/output devices, and/or network interfaces, among others.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A method performed by an event analysis system having one or more hardware computer processors and one or more non-transitory computer readable storage device storing software instructions executable by the computing system, the method comprising:

receiving, from a vehicle device coupled to a vehicle, first event data including at least metadata associated with a safety event detected by the vehicle device, wherein the metadata indicates at least a vehicle device identifier, a type of event, an event time, and a maximum G force detected by one or more sensors of the vehicle device, wherein the vehicle device is configured to emit an audible alert in response to detecting the safety event, wherein the safety event indicates one or more of a collision, harsh braking, harsh acceleration, or harsh turning of the vehicle;

determining, based at least on the type of event indicated in the first event data, second event data including one or more assets associated with the type of event, the one or more assets including at least a video file for a first duration prior to the event time and a second duration after the event time;

transmitting an asset data request for the second event data to the vehicle device;

receiving, from the vehicle device, the second event data;

training an event model associated with the type of event based on at least some of the event data; and providing the event model to the vehicle device, wherein the event model is used by the vehicle device to detect the type of event.

2. The method of claim 1, wherein the determined one or more assets are received via a cellular data communication network.

3. The method of claim 1, further comprising:

analyzing the first event data and the second event data to determine accuracy of the detected safety event; and generating user interface data configured to display the video file and at least some of the first event data.

4. The method of claim 3, wherein the user interface data includes an option for a user to indicate accuracy of the detected safety event.

5. The method of claim 1, wherein the vehicle device is configured to detect the safety event in response to a detected G force exceeding a threshold.

6. The method of claim 5, wherein the threshold is user configurable.

7. The method of claim 6, wherein the threshold is user configurable based on preset G force levels associated with a type of vehicle, wherein types of vehicles include at least passenger, light duty, and heavy duty.

8. A computing system comprising:

a vehicle device coupled to a vehicle, the vehicle device configured to:

access sensor data from one or more vehicle sensors;

for each of a plurality of safety events:

determine whether criteria for a harsh event are matched and, if matched, provide an audible and/or visual alert of the harsh event within the vehicle;

transmit metadata associated with the harsh event to an event analysis system, the metadata including at least a type of event and a G force level sensed by one or more accelerometers associated with the vehicle; and receive and respond to requests for data assets from the event analysis system; and the event analysis system configured to:

receive the metadata associated with the detected harsh event;

determine, based at least on a type of event indicated in the metadata, whether data assets associated with the detected harsh event should be requested;

in response to determining that data assets should be requested, transmitting a data asset request to the vehicle device, wherein the data assets include at least a video file from an outward-facing or a driver-facing camera within the vehicle; and generating user interface data configured to display the video file and the metadata.

9. The computing system of claim 8, wherein the data assets include one or more of: video files, still images, audio data, accelerometer data, global positioning system (GPS) data, ECU data, vehicle speed data, forward camera object tracking data, driver facing camera data, and hand tracking data.

10. The computing system of claim 8, wherein a still image is transmitted with the metadata.

11. The computing system of claim 8, wherein the metadata includes sensor data from a first sensor and the data assets include sensor data from one or more additional sensors.

12. The computing system of claim 11, wherein the first sensor comprises an accelerometer and the one or more additional sensors comprise one or more cameras mounted to the vehicle.

13. The computing system of claim 8, wherein said determining whether data assets associated with the detected harsh event should be requested is based on a listing of data assets associated with the event type.

14. The computing system of claim 8, wherein the event type is one or more of a collision, harsh acceleration, harsh braking, or harsh turning.

* * * * *